US007081036B1

(12) United States Patent
Howard et al.

(10) Patent No.: US 7,081,036 B1
(45) Date of Patent: Jul. 25, 2006

(54) BUTTOCK LIFT SUPPORT

(76) Inventors: Stacy D. Howard, 4875 Berkshire, Detroit, MI (US) 48224; Janeen L. Howard, 4875 Berkshire, Detroit, MI (US) 48224

( * ) Notice: Subject to any disclaimer, the term of this patent is extended or adjusted under 35 U.S.C. 154(b) by 0 days.

(21) Appl. No.: 10/842,642

(22) Filed: May 10, 2004

Related U.S. Application Data

(60) Provisional application No. 60/469,327, filed on May 9, 2003.

(51) Int. Cl.
*A41C 1/00* (2006.01)

(52) U.S. Cl. ..... 450/100; 450/99

(58) Field of Classification Search ..... 450/100, 450/101, 106, 107, 98, 99, 122–124, 131, 450/151, 155; 2/400, 406, 408, 69, 228, 2/238, 227
See application file for complete search history.

(56) References Cited

U.S. PATENT DOCUMENTS

| | | | | | |
|---|---|---|---|---|---|
| 1,668,743 | A * | 5/1928 | Stuart | 450/130 |
| 2,775,767 | A * | 1/1957 | Gould | 450/106 |
| 3,524,449 | A * | 8/1970 | Peters | 450/100 |
| 4,698,847 | A * | 10/1987 | Yoshihara | 2/69 |
| 5,784,723 | A * | 7/1998 | Noble et al. | 2/400 |
| 5,974,592 | A * | 11/1999 | Tabrizi | 2/400 |
| 6,159,070 | A * | 12/2000 | Schwartz et al. | 450/155 |
| 6,360,375 | B1 * | 3/2002 | Hart | 2/406 |
| 6,430,753 | B1 * | 8/2002 | Duran | 2/239 |
| 6,728,973 | B1 * | 5/2004 | Webley et al. | 2/400 |

* cited by examiner

*Primary Examiner*—Gloria M. Hale
(74) *Attorney, Agent, or Firm*—John R. Benefiel

(57) ABSTRACT

A buttock lift support extends a lift band from each of a pair of elastic leg bands to a waistband so as to wrap around the buttocks of the wearer and exert an upward pressure thereon. Side, rear and front panels, and a thong strap can be incorporated to create a panty garment having the lift support integrated therein.

6 Claims, 6 Drawing Sheets

BUTTOCK LIFT SUPPORT

CROSS REFERENCE TO RELATED APPLICATION

This application claims the benefit of U.S. provisional Ser. No. 60/469,327, filed May 9, 2003.

BACKGROUND OF THE INVENTION

This invention concerns body supports and more particularly buttocks shaping supports which when worn produce an uplifting effect to improve the wearer's physique.

Various contrivances have been devised to shape and lift the buttocks, but these have been less than effective, produce an unnatural look or feel, and/or are uncomfortable to wear.

It is the object of the present invention to provide a buttocks shaping support which is effective to produce a natural looking uplift to the buttocks of the wearer, and is comfortable when worn.

SUMMARY OF THE INVENTION

The above object and other objects which will become apparent upon a reading of the following specification and claims are achieved by a buttocks lift support including a pair of elastic bands which tightly encircle the upper thighs of the wearer. Each thigh encircling elastic band has the bottom of a wide elastic lift band attached to the inside facing areas of the respective encircling elastic bands.

These lift bands each are wrapped around and beneath a respective buttock and are spiraled upwardly over the outside of the hip, extending to a waist band encircling the waist of the wearer. The upper ends of the lift bands are attached to the waist band at a point above and forward of the wearer's hip.

A tightening strap is attached to the rear of the waist band which allows the waist band to be tightened to be sufficiently taut to hold the lift bands.

The lift bands are sufficiently wide to insure cradling of the buttock and avoid indentation created by sinking in of the bands, insuring a smooth contour of the uplifted buttock held by the tension in the lift bands. These bands while elastic are sufficiently stiff to generate a significant lifting force on the wearer's buttocks when the support is worn.

The elastic bands may be held together on their inside and outside parts by connecting crotch strap sewn to the leg portions and the waist band to define a garment.

Various undergarment configurations may incorporate these lift support elements. Covering fabric panels may be sewn to the lift bands and crotch strap at the front of the rear or on both sides to create a panty like undergarment incorporating the buttocks uplift support.

DETAILED DESCRIPTION

Figure 1A:
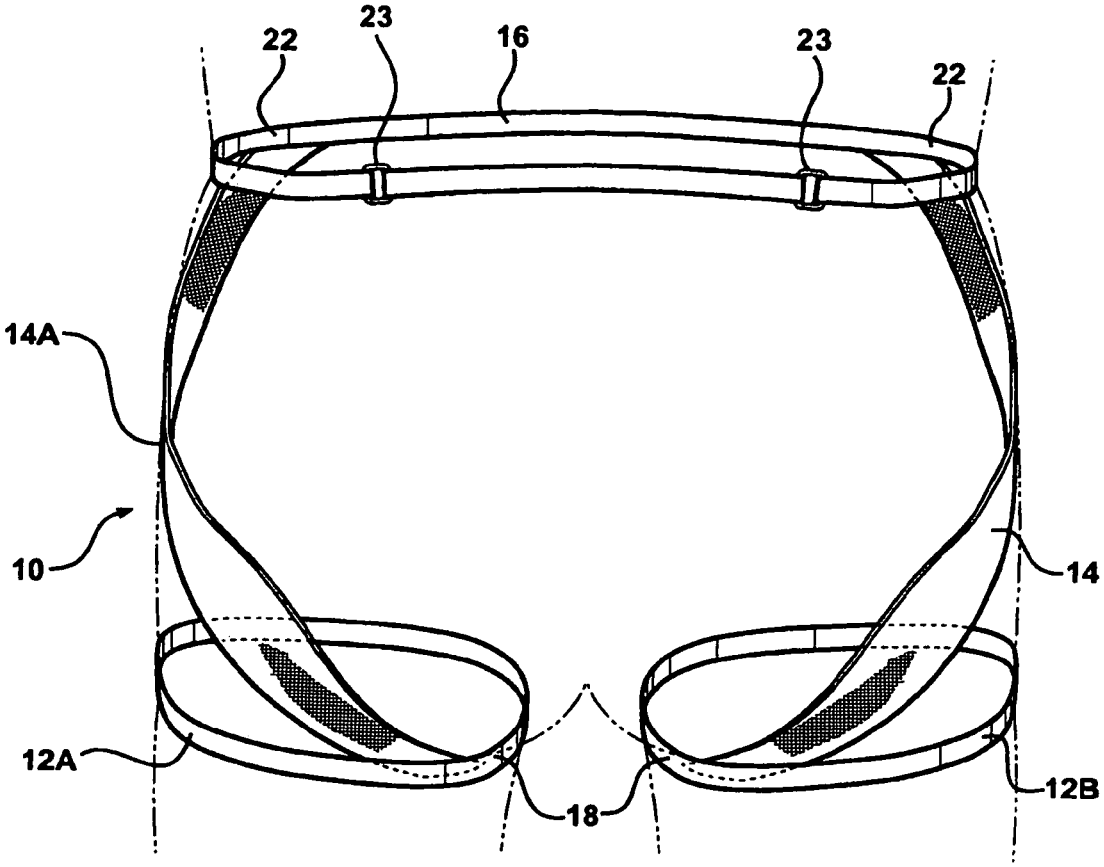
FIG. 1A is a rear view of a first form of the buttock lift support according to the invention with a partial outline in phantom lines of a wearer's body.
Figure 1B:
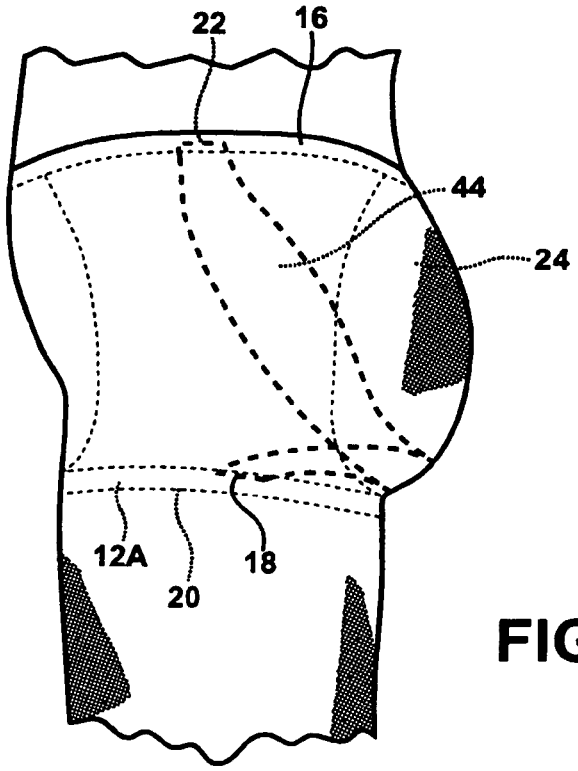
FIG. 1B is a side view of a second form of the buttock lift support according to the invention, with a portion of a wearer's body shown with separate outer garment.

Referring to FIG. 1A, a first embodiment of a buttock lift support 10 is shown; which includes a pair of thigh encircling elastic bands 12A, 12B adapted to be slipped onto the upper thigh of the wearer as indicated, and tightly fit thereto.

An elastic waist band 16 tightly encircles the waist of the wearer, with hooked fittings 23 allowing a tightening of the waist band 16 to snugly fit the waist and be able to support lift bands 14A, 14B.

A pair of elastic lift bands 14A, 14B are also provided, the lower end of each lift band 14A, 14B sewn or otherwise attached to a respective thigh encircling elastic bands 12A, 12B at the inner thigh region 18 thereof.

Each lift band 14A, 14B extends outwardly and upwardly to a point of attachment 20 to the waistband 16, forwardly and on the hip of the wearer. Each lift band 14A, 14B wraps around beneath a buttock and winds upward over a hip of the wearer in an approximate spiraling manner. The length and the stiffness of the lift bands 14A, 14B is selected so as to cause the buttocks to be lifted when the support is worn. This also slightly separates the buttocks slightly. The waistband 16 provides a support to hold the lift bands 14A, 14B securely while they exert an upward lift on the buttocks of the wearer. It will be understood that a lift is also thereby exerted on the thigh encircling elastic bands 12A, 12B. A slight buttock separating force is also generated at the same time.

The support 10 may be worn beneath an outer garment 24.

The lift bands 14A, 14B are sufficiently wide, on the order of three inches, so that a smooth shape is maintained despite the pressure exerted in maintaining lift pressure on the buttocks.

The lift bands 14A, 14B also exert a lifting force on the upper thigh encircling elastic bands 12A, 12B.

Figure 2:
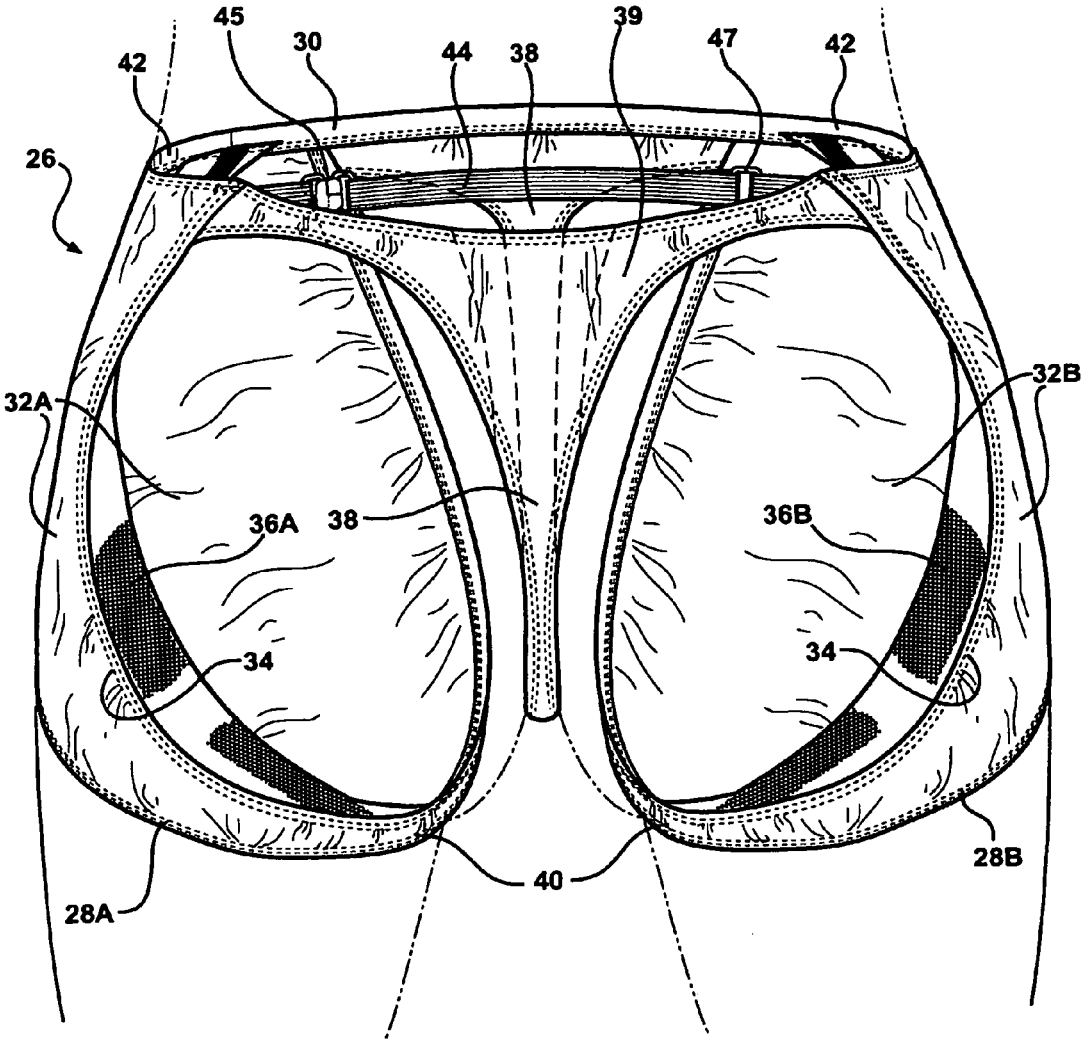
FIG. 2 is a rear view of a first embodiment panty garment incorporating the second form of the buttock lift support of FIG. 1A with partial outline of a wearer's body shown in phantom lines.

FIG. 2 shows a panty garment 26 incorporating the buttock lift support according to the invention.

A pair of thigh encircling elastic bands 28A, 28B are provided as in the above described embodiment which both are connected to a waist band 30 by side fabric panels 32A, 32B which extend forwardly over the pelvis of the wearer. A hem 34 extends around a rear opening and the front edge of the panels 32.

A front to rear extending crotch strap 38 is also secured to the waistband 30 via included triangular fabric panels 39.

A pair of lift bands 36A, 36B have their bottom ends sewn to a respective one of the thigh encircling elastic bands 28A, 28B at the inner thigh region 40, and at their top to the waistband 30 at the hip region 42, which may be sewn at a point on the waistband so slightly on the forward side thereof.

A hook 45 connects the ends of an elastic strap 44 is sewn inside the waist band 30, adjustable to a slide 47 to allow tightening of the waist band 30 to provide secure support for the lift bands 36A, 36B when lifting the wearer's buttocks.

Figure 3:
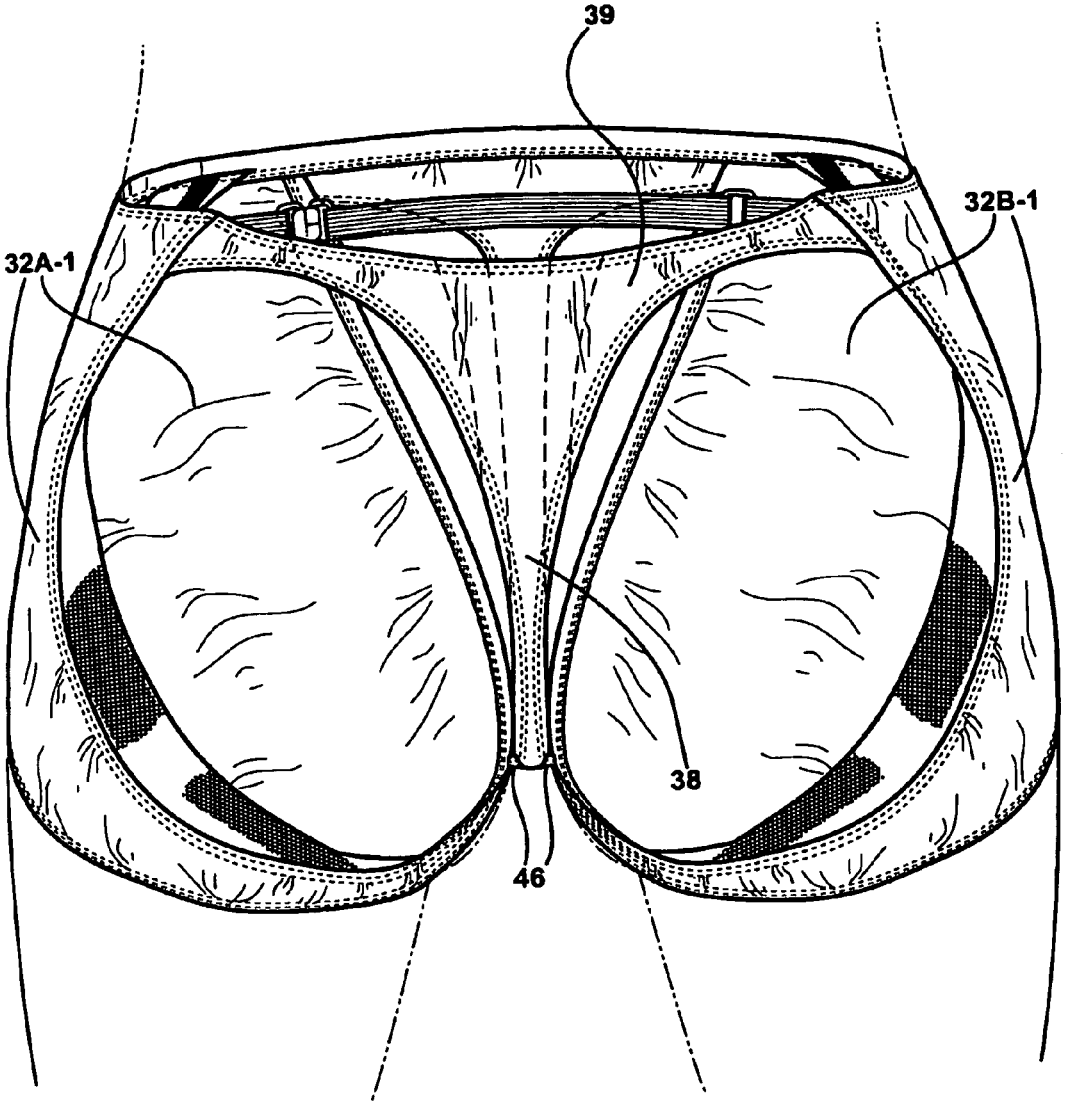
FIG. 3 is a rear view of a modified version of the panty garment shown in FIG. 2, with partial outline of a wearer's body shown in phantom lines.

In the embodiment of FIG. 3, the side fabric panels 32A-1 and 32B-1 are extended to be sewn to the crotch strap 38 at 46.

Figure 4:
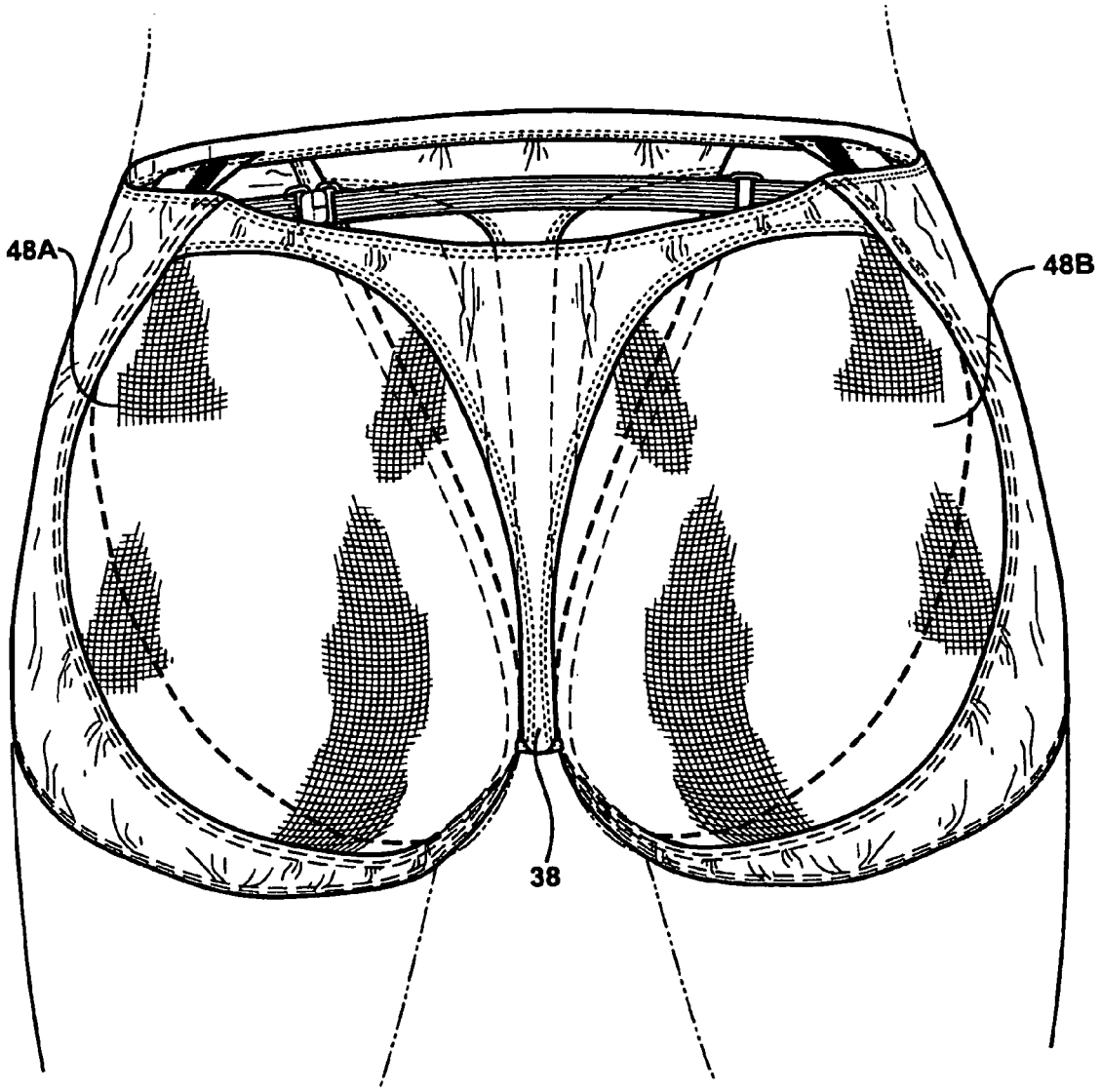
FIG. 4 is a rear view of another embodiment of a panty garment incorporating a buttock lift support according to the invention, with partial outline of a wearer's body shown in phantom lines.
Figure 5:
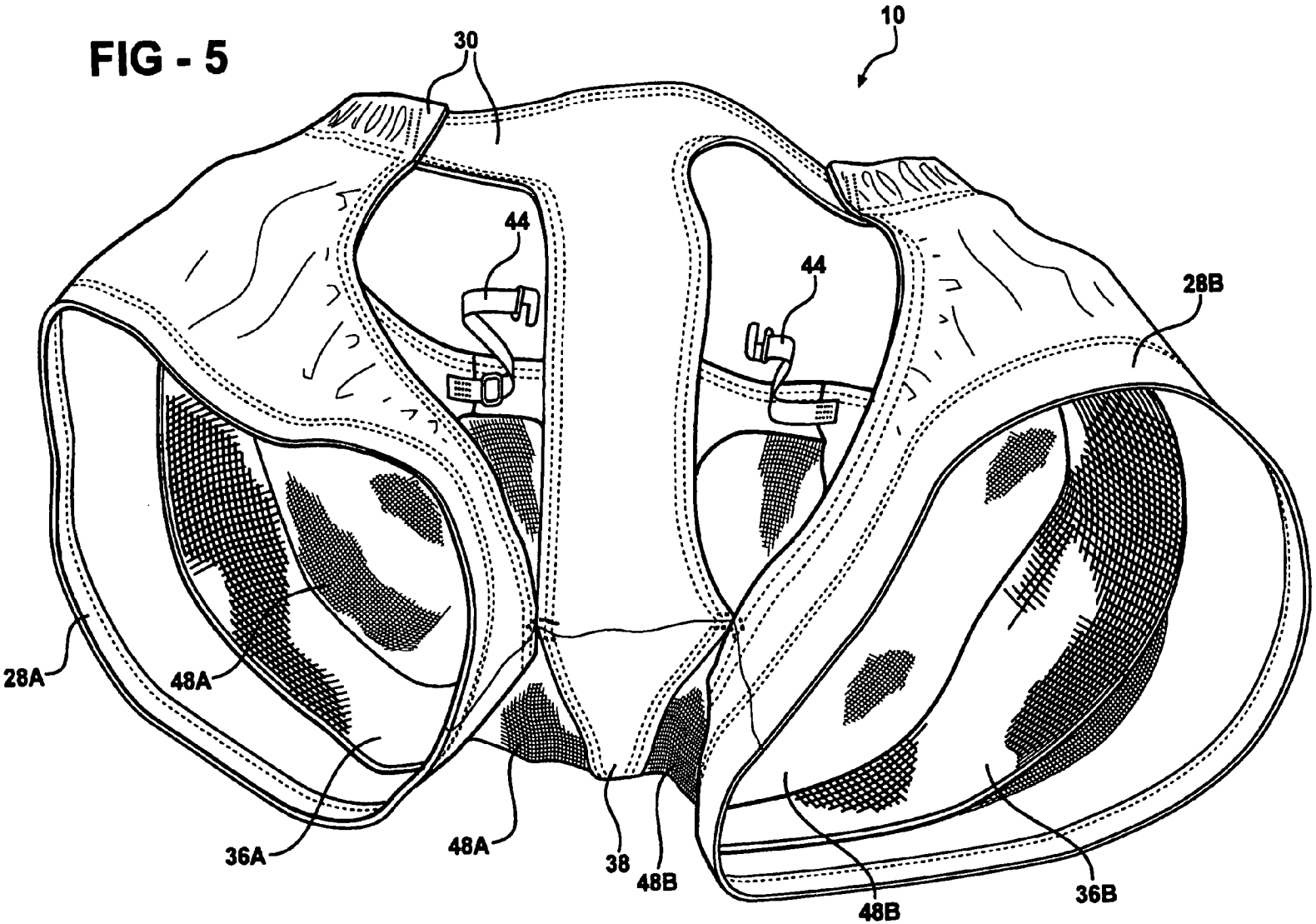
FIG. 5 is a pictorial view of the panty garment shown in FIG. 4.

In FIGS. 4 and 5 rear fabric panels 48A, 48B are sewn into the rear buttock openings to close the same. The panels 48A, 48B are also sewn to the crotch strap 38.

Figure 6:
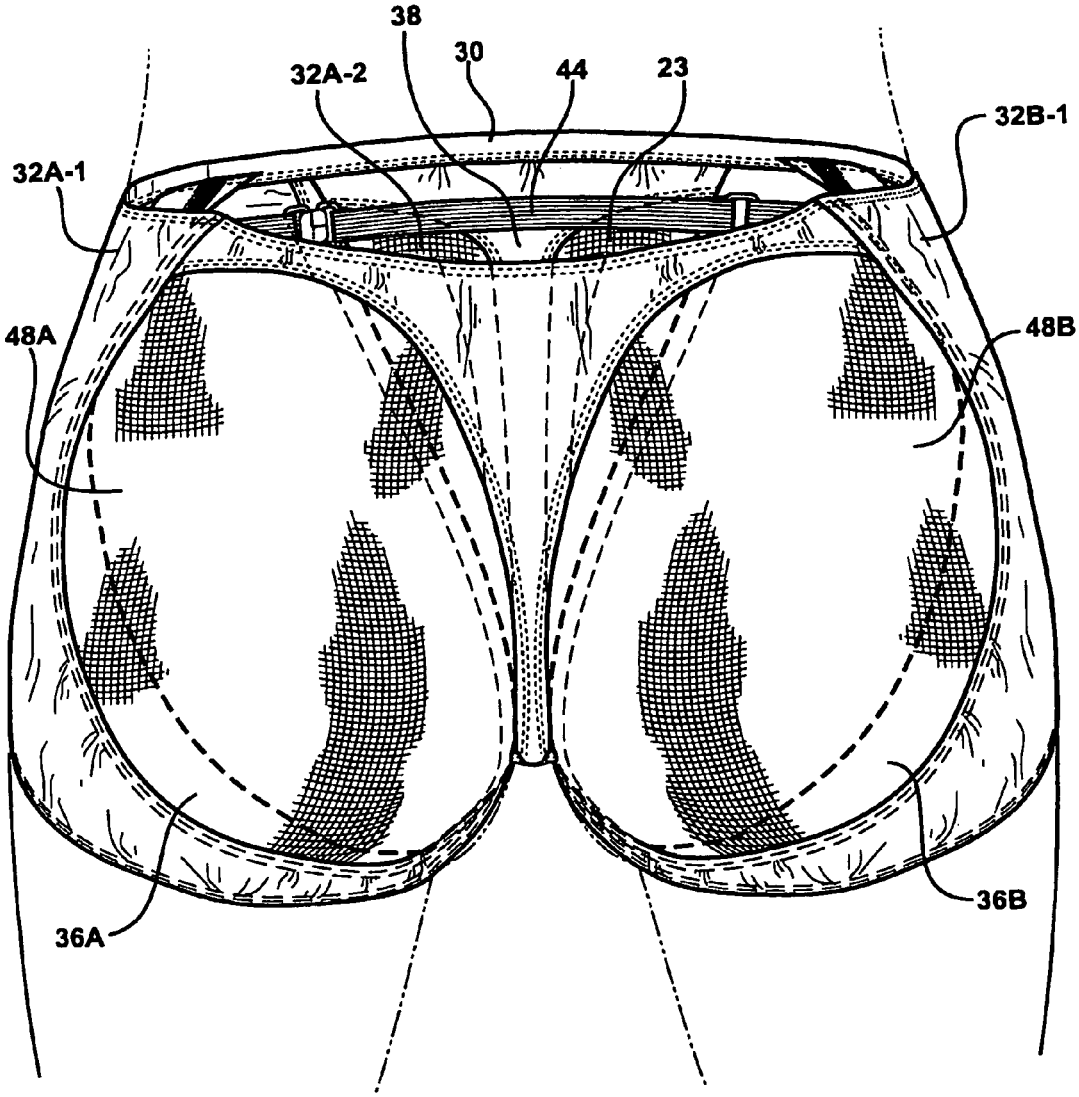
FIG. 6 is a rear view of yet another embodiment of a panty garment incorporating the buttock lift support according to the invention, with partial outline of a wearer's body shown in phantom lines.

FIG. 6 shows a panty garment in which auxiliary side fabric panels 32A-2, 32B-2 extending to the crotch strap 38 at the front are sewn to the side panels 32A-1, 32B-1.

Thus, a comfortable yet highly effective buttock lift support is provided integrated with a panty garment.

The invention claimed is:

1. A buttocks lift support comprising:

a pair of thigh encircling elastic bands adapted to tightly fit the upper thighs of a wearer;

an elastic waistband adapted to be tightly fit to the waist of a wearer;

a pair of lift bands, each lift band attached at a lower end to a respective thigh encircling band at an inner thigh region and at an upper end to a respective side of said waistband at a hip location thereon, so that said lift bands wrap around beneath the buttocks of the wearer and spiral up and out to said waistband, said lift bands being tightly engaged with a wearer's buttocks when said lift support is worn to exert a significant lifting force thereon and also on the thigh encircling elastic bands;

a side panel sewn to an outer side of each of said thigh encircling elastic bands and extending up and over a wearer's hips to a respective side of said waistband to thereby cover the wearer's hips; and a crotch strap extending from the front of said waistband to the rear of said waistband to pass over the crotch area of the wearer, which together with said side panels form a panty garment.

2. A buttocks lift support according to claim 1 further including an adjustable hooked strap secured to said waistband to allow tightening of said waistband to enhance support of said lift bands.

3. A buttocks lift support according to claim 1 wherein said lift bands have a width on the order of three inches in a region engaging the wearer's buttocks.

4. A buttocks lift support according to claim 3 wherein said lift bands are elastic, but still stiff enough to exert a substantial lift.

5. A buttocks lift support according to claim 1 wherein said crotch strap is sewn to said thigh encircling elastic bands at said inside thigh region.

6. A buttocks lift support according to claim 5 further including a pair of rear fabric panels, each sewn between a respective side of a rear segment of said crotch strap, said side panels, and the rear of said waistband to cover the wearer's buttocks.

* * * * *